US010260262B2

(12) United States Patent
Jiang

(10) Patent No.: US 10,260,262 B2
(45) Date of Patent: Apr. 16, 2019

(54) INTEGRATED HINGE STRUCTURE

(71) Applicant: PLASTIC DEVELOPMENT GROUP, Southfield, MI (US)

(72) Inventor: Yixiang Jiang, Yuyao (CN)

(73) Assignee: PLASTIC DEVELOPMENT GROUP, Southfield, MI (US)

( * ) Notice: Subject to any disclaimer, the term of this patent is extended or adjusted under 35 U.S.C. 154(b) by 124 days.

(21) Appl. No.: 15/401,070

(22) Filed: Jan. 8, 2017

(65) Prior Publication Data

US 2017/0342753 A1 Nov. 30, 2017

(30) Foreign Application Priority Data

May 27, 2016 (CN) ..... 2016 1 0373590

(51) Int. Cl.
*E05D 7/10* (2006.01)
*E05D 3/02* (2006.01)
*E05D 7/00* (2006.01)

(52) U.S. Cl.
CPC ..... *E05D 7/1072* (2013.01); *E05D 3/02* (2013.01); *E05D 7/10* (2013.01); *E05D 7/009* (2013.01); *E05Y 2900/602* (2013.01)

(58) Field of Classification Search
CPC .... E05D 1/04; E05D 1/06; E05D 3/02; E05D 7/009; E05D 7/10; E05D 7/1066; E05D 7/1072; E05D 7/12; E05Y 2900/602
USPC ..... 16/260, 267, 271, 355–356, 386–387, 16/234, 254, 217
See application file for complete search history.

(56) References Cited

U.S. PATENT DOCUMENTS 771,654 A * 10/1904 Meek ..... E05D 7/1066 16/267
2,732,581 A * 1/1956 Heck ..... E05D 5/10 16/224
3,126,120 A * 3/1964 Crate ..... E05D 5/10 16/267
4,358,871 A * 11/1982 Takai ..... E05D 3/02 16/262
4,379,360 A * 4/1983 Papsdorf ..... B21D 53/40 16/321
5,452,847 A * 9/1995 Harris ..... B65D 5/66 16/373
6,000,550 A * 12/1999 Simpson ..... E05D 7/1077 16/257
8,066,143 B2 * 11/2011 Baltz ..... B65D 1/22 220/324
2004/0000030 A1 * 1/2004 Pleiman ..... A45C 13/005 16/267

* cited by examiner

*Primary Examiner* — Roberta S Delisle
(74) *Attorney, Agent, or Firm* — Brooks Kushman P.C.

(57) ABSTRACT

An integrated hinge structure is disclosed herein, comprising a hinge shaft provided on a first connecting member and a hinge arm provided on a second connecting member, the hinge arm being rotatably connected to the hinge shaft, wherein a coupling structure is formed between the hinge shaft and the hinge arm, the coupling structure allowing the hinge arm only to be installed to or detached from the hinge shaft in a certain direction and allowing the installed hinge arm to rotate for any angle or freely while staying connected to the hinge shaft. Furthermore, the hinge shaft and the hinge arm are respectively formed integrally on the corresponding connecting members, providing a simple and firm structure.

19 Claims, 8 Drawing Sheets

INTEGRATED HINGE STRUCTURE

RELATED APPLICATIONS

This application claims priority to Chinese patent application 201610373590.1, filed May 27, 2016, and entitled "INTEGRATED HINGE STRUCTURE", the disclosure of which is hereby incorporated herein by reference in its entirety for all purposes.

FIELD OF THE INVENTION

The present disclosure relates to a hinge structure, especially an integrated hinge structure.

BACKGROUND

There are a variety of hinge structures with different configurations in the prior technologies. For example, two connecting boards are usually rotatably connected via a hinge structure. Such a prior hinge structure usually includes an upper blade and a lower blade symmetrically arranged, wherein the upper blade is fastened onto the first connecting board with screws, the lower blade is fastened onto the second connecting board with screws, and a rotating shaft is provided in the rotating shaft holes of the upper and lower blades and held in place, thus connecting together the upper and lower blades. This type of hinge structure, though simple, requires the blades to be fixed on the corresponding connecting boards in advance during assembly. The blade installation is time-consuming. And, when not installed in the proper alignment position, the two connecting boards may encounter difficulty in opening and closing due to friction. Then, one must adjust the clearance between the two connecting boards by disassembling and retightening the positions of the upper and lower blades, which is both time and labor consuming. Overall, improvements are needed for the prior hinge structure.

SUMMARY OF THE INVENTION

In view of the prior arts above, one technical solution to be solved by the present disclosure is to provide an integrated hinge structure with convenient assembly and disassembly.

A technical solution according to the disclosure is an integrated hinge structure, comprising a hinge shaft provided on a first connecting member and a hinge arm provided on a second connecting member, the hinge arm rotatably embracing the hinge shaft, wherein a coupling structure is formed between the hinge shaft and the hinge arm, the coupling structure allowing the hinge arm only to be installed to or detached from the hinge shaft in a certain direction or a predetermined direction and allowing the installed hinge arm to rotate for any angle while staying connected to the hinge shaft.

Various coupling structures may be provided between the hinge shaft and the hinge arm. Preferably, the hinge shaft may be a circular shaft, a first cutting face and a second cutting face that are parallel to each other may be formed axially on a side of the hinge shaft, the first cutting face and the second cutting face being at least one each, alternately arranged, and respectively located on two opposite sides of the hinge shaft. Correspondingly, the hinge arm may comprise a first arc-shaped embracing arm and a second arc-shaped embracing arm, the first arc-shaped embracing arm and the second arc-shaped embracing arm being at least one each, alternately arranged with their arc opening facing each other, and respectively located on two opposite sides of the hinge arm. Further, the vertical distance between opposite edges of the first arc-shaped embracing arm and the second arc-shaped embracing arm may be greater than the vertical distance between the first cutting face and the second cutting face but smaller than the diameter of the hinge shaft.

According to some embodiments, the first cutting face and the second cutting face may be precisely staggered along an axial direction of the hinge shaft, the first cutting face and the second cutting face having an equal cutting depth that may be smaller than a radius of the hinge shaft. And, correspondingly, the first arc-shaped embracing arm and the second arc-shaped embracing arm (22) may be precisely staggered along an axial direction of the hinge arm.

According to some embodiments, the first cutting face and the second cutting face may be the same in their axial width. And correspondingly the first arc-shaped embracing arm and the second arc-shaped embracing arm may be the same in their axial width. In this way, the hinge shaft and the hinge arm will be better in structural symmetry and easier for machine shaping.

According to some embodiments, the hinge shaft may comprise one first cutting face and two second cutting faces, the first cutting face being located between the two second cutting faces. And, correspondingly, the hinge arm may comprise one first arc-shaped embracing arm and two second arc-shaped embracing arms, the first arc-shaped embracing arm being located between the two second arc-shaped embracing arms (22). In this way, the hinge shaft and the hinge arm are made simpler in the structure while the firmness of the installation structure is ensured.

According to some embodiments, the first cutting face and the second cutting face may be level surfaces. Accordingly, the certain direction, of which the hinge arm can only be inserted into or detached from the hinge shaft, is the horizontal direction.

According to some embodiments, the hinge shaft may be integrally formed on the first connecting member and the hinge arm may be integrally formed on the second connecting member. When the hinge shaft and the hinge arm each employ an integrally-formed structure, it is possible to allow the hinge structure to be simpler but strong enough in the structural strength.

According to some embodiments, the first connecting member may be a first connecting board, and the second connecting member may be a second connecting board. A plurality of hinge mounts and a plurality of the hinge shafts may be integrally formed along a length direction of a side edge of the first connecting board, the hinge shafts being arranged on the hinge mounts in an alternate manner with the hinge mounts. And, correspondingly, a plurality of the hinge arms may be integrally formed in a spaced manner along a length direction of a corresponding side edge of the second connecting board. With the use of the above structure, it is possible to assemble and disassemble the first connecting board and the second connecting board in a convenient manner.

Compared with the prior art, the present disclosure is advantageous in that: the first connecting member and the second connecting member of this integrated hinge structure have a specific assembling and disassembling direction. That is, a coupling structure is formed between the hinge shaft and the hinge arm, the coupling structure allowing the hinge arm only to be installed to or detached from the hinge shaft in a certain direction or a predetermined direction and allowing the installed hinge arm to rotate for any angle while staying connected to the hinge shaft. Therefore, the assembly and disassembly of this hinge structure is very convenient. Furthermore, the hinge shaft and the hinge arm are respectively formed integrally on the corresponding connecting members, providing a simple and firm structure.

DETAILED DESCRIPTION OF EMBODIMENTS

Figure 1:
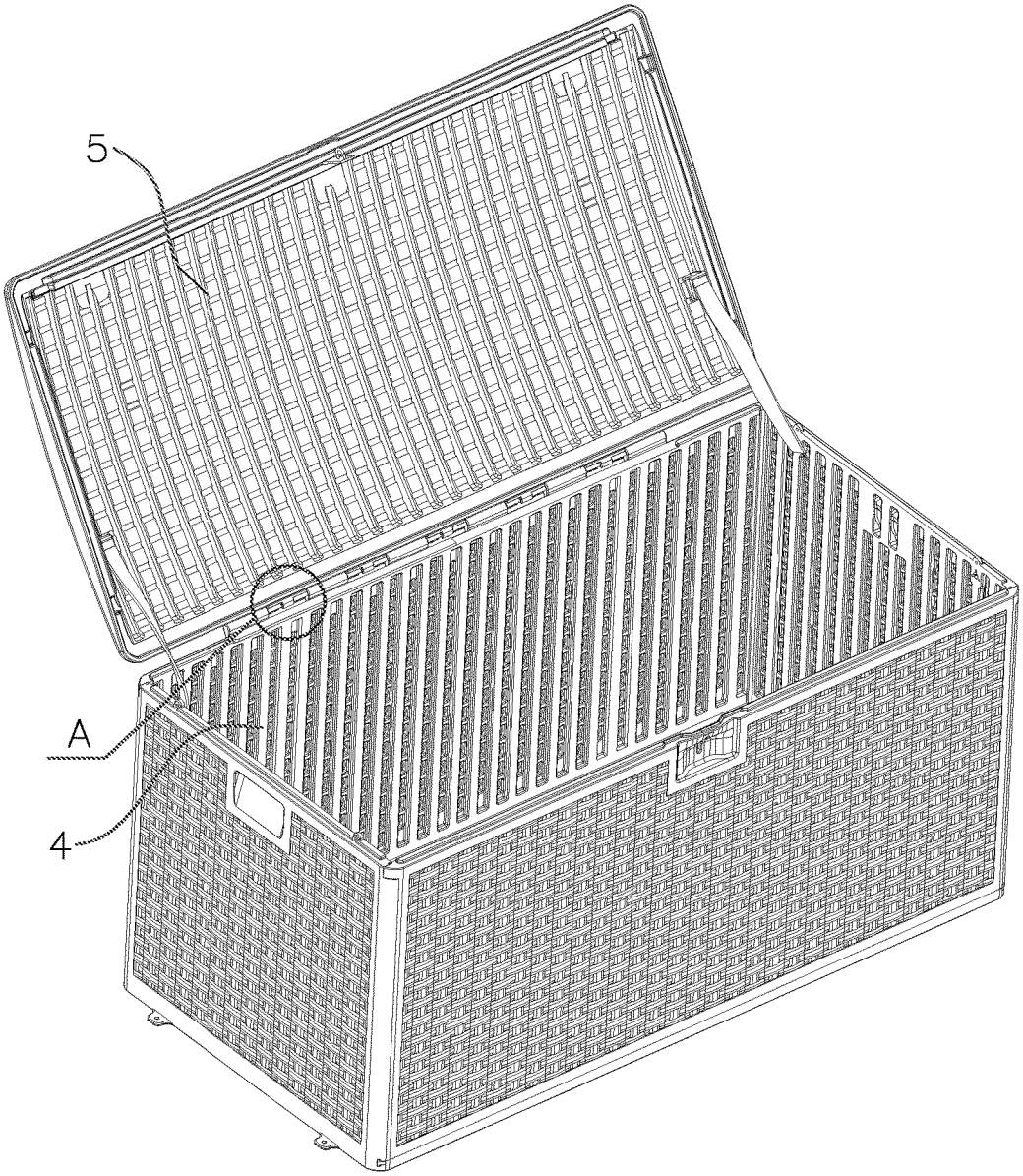
FIG. 1 is a structural schematic of the cover board in a fixed position according to an embodiment of the present disclosure.

The present disclosure will be described in further details below with reference to embodiments as shown in the attached figures.

As shown in FIG. 1 through 8, the integrated hinge structure of this embodiment can be applied to a box for connecting the rear board 4 and the cover board 5, wherein the rear board 4 is the first connecting board, or a first connecting member, and the cover board 5 is the second connecting board, or a second connecting member. A plurality of hinge mounts 3 and a plurality of the hinge shafts 1 are integrally formed along the length direction of a side edge of the rear board 4 without the use of any fixation means such as screws. The hinge shafts 1 are arranged on the hinge mounts 3 in an alternate manner with the hinge mounts 3. And, correspondingly, a plurality of the hinge arms 2 is integrally formed in a spaced manner along a length direction of a corresponding side edge of the cover board 5. Specifically, an integrally formed component is part of the board that is not fixed or attached through any fixation means such as screws or glue.

According to some embodiments, the following description illustrates a coupling structure between one hinge shaft 1 and one hinge arm 2.

According to some embodiments, the hinge shaft 1 is a circular shaft. A first cutting face 11 and a second cutting face 12 that are parallel to each other are formed axially on a side of the hinge shaft 1. Particularly, the first cutting face 11 is one upper level surface, and the second cutting faces 12 are two lower level surfaces. The first cutting face 11 is located between the two second cutting faces. That is, the first cutting face 11 and the second cutting face 12 are alternately arranged and respectively located on two opposite sides of the hinge shaft 1.

Furthermore, the first cutting face 11 and the second cutting face 12 are precisely staggered along an axial direction of the hinge shaft 1, while the first cutting face 11 and the second cutting face 12 have an equal cutting depth that is smaller than a radius of the hinge shaft 1.

According to some embodiments, a first arc-shaped embracing arm 21 and a second arc-shaped embracing arm 22 are formed axially on the hinge arm 2. The first arc-shaped embracing arm 21 is located between the second arc-shaped embracing arms 22. That is, the first arc-shaped embracing arms 21 and the second arc-shaped embracing arms 22 are alternately arranged, with their arc opening facing each other, and respectively located on two opposite sides of the hinge arm 2. Further, the vertical distance between the opposite edges of the first arc-shaped embracing arm 21 and the second arc-shaped embracing arm 22 is greater than the vertical distance between the first cutting face 11 and the second cutting face 12, but smaller than a diameter of the hinge shaft 1.

To couple the first cutting face 11 with the second cutting face 12, the first arc-shaped embracing arm 21 and the second arc-shaped embracing arm 22 are precisely staggered along an axial direction of the hinge arm 2, and the first arc-shaped embracing arm 21 and the second arc-shaped embracing arm 22 have the same axial width.

Figure 2:
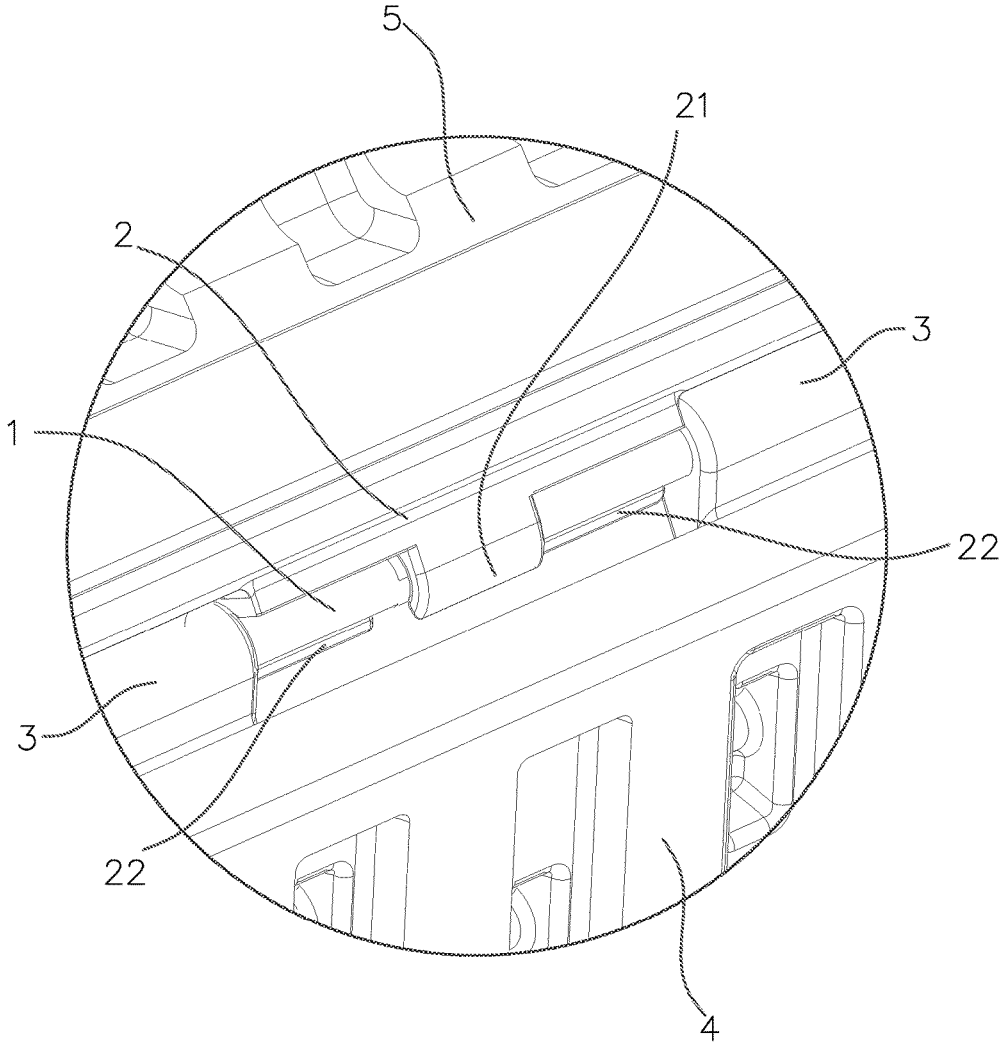
FIG. 2 is an enlarged schematic of the portion A in FIG. 1.
Figure 3:
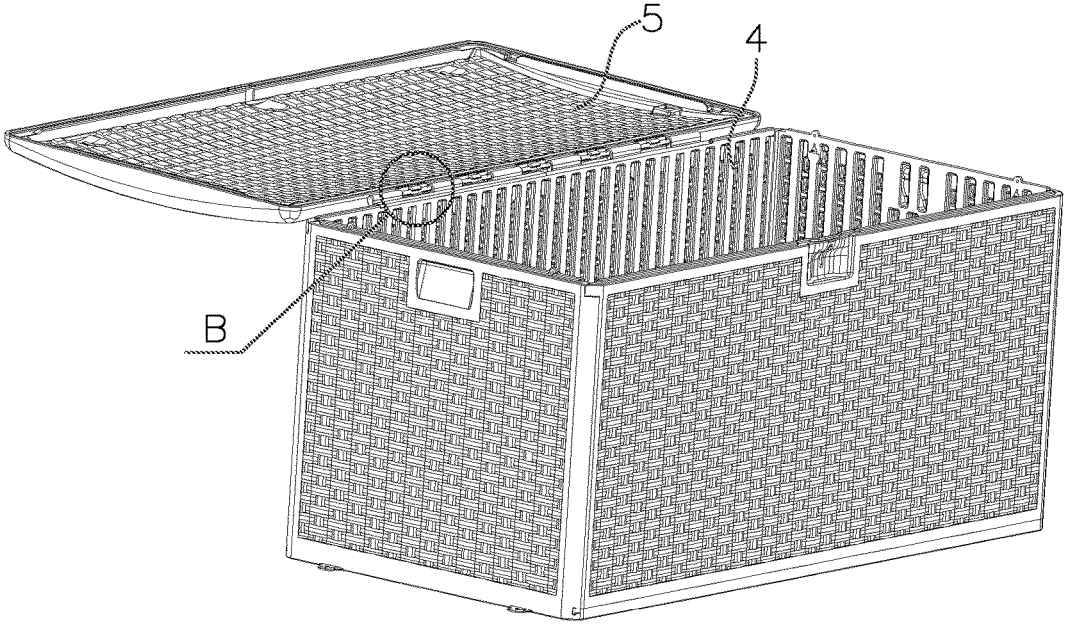
FIG. 3 is a structural schematic of the cover board in a removable position according to an embodiment of the present disclosure.
Figure 4:
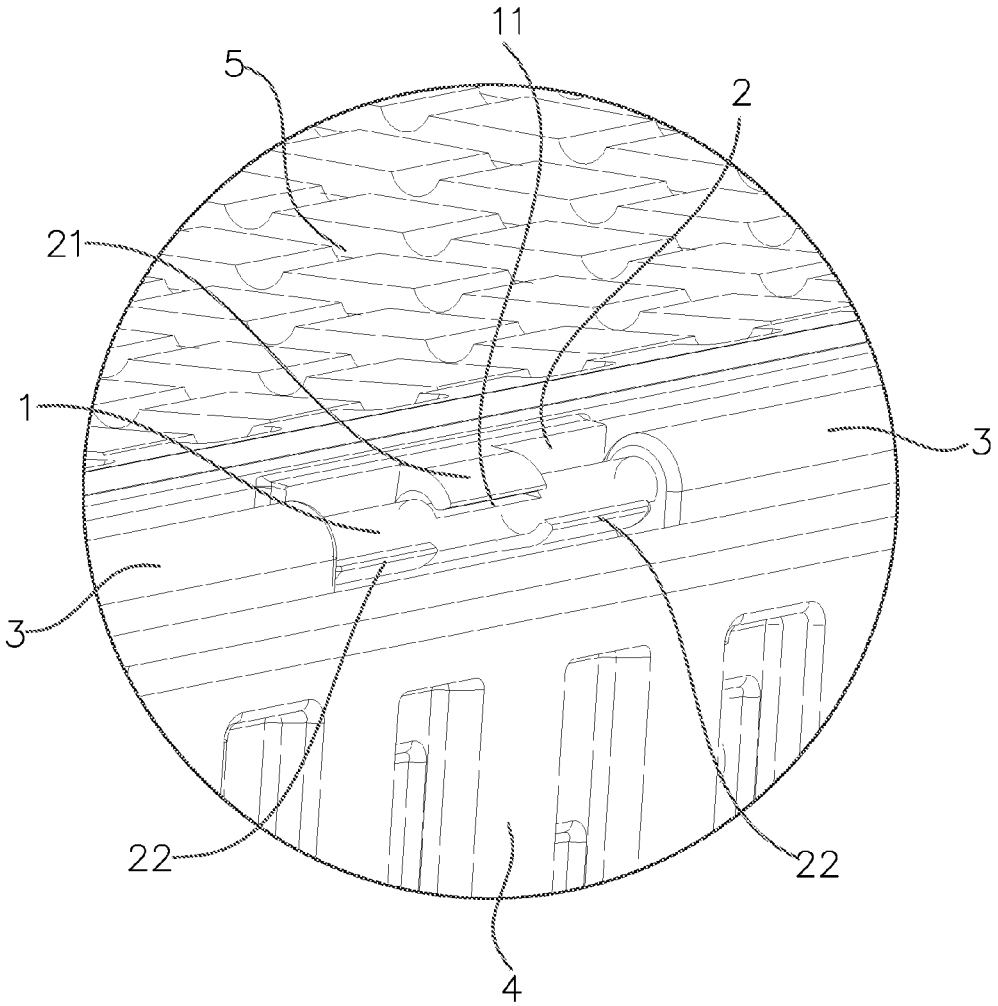
FIG. 4 is an enlarged schematic of the portion B in FIG. 3.
Figure 5:
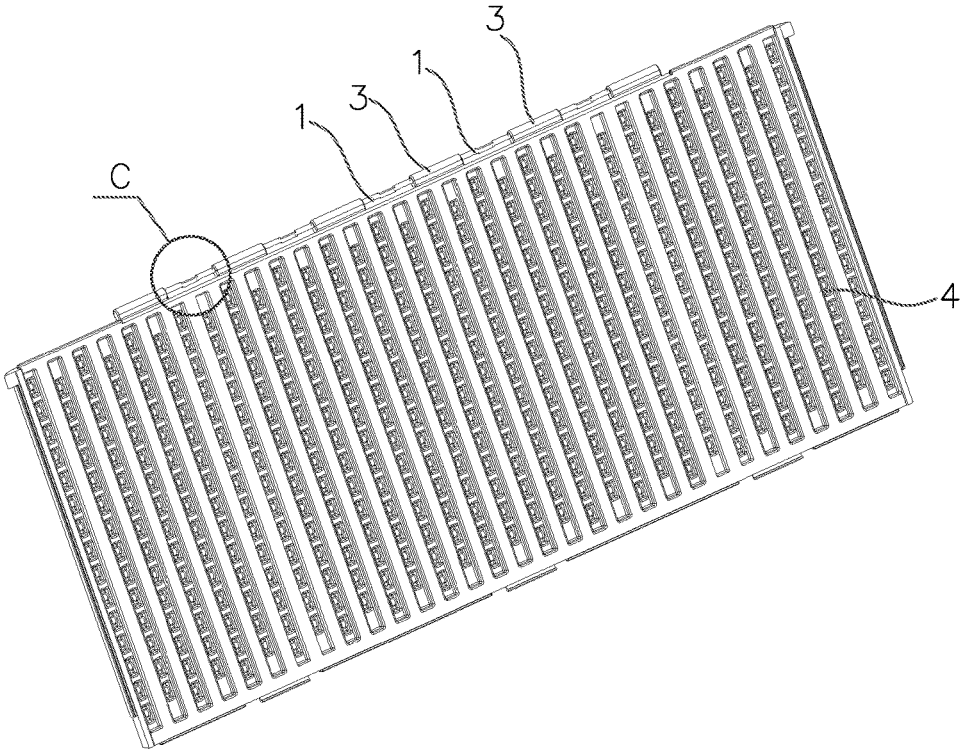
FIG. 5 is a structural schematic of the rear board according to an embodiment of the present disclosure.
Figure 6:
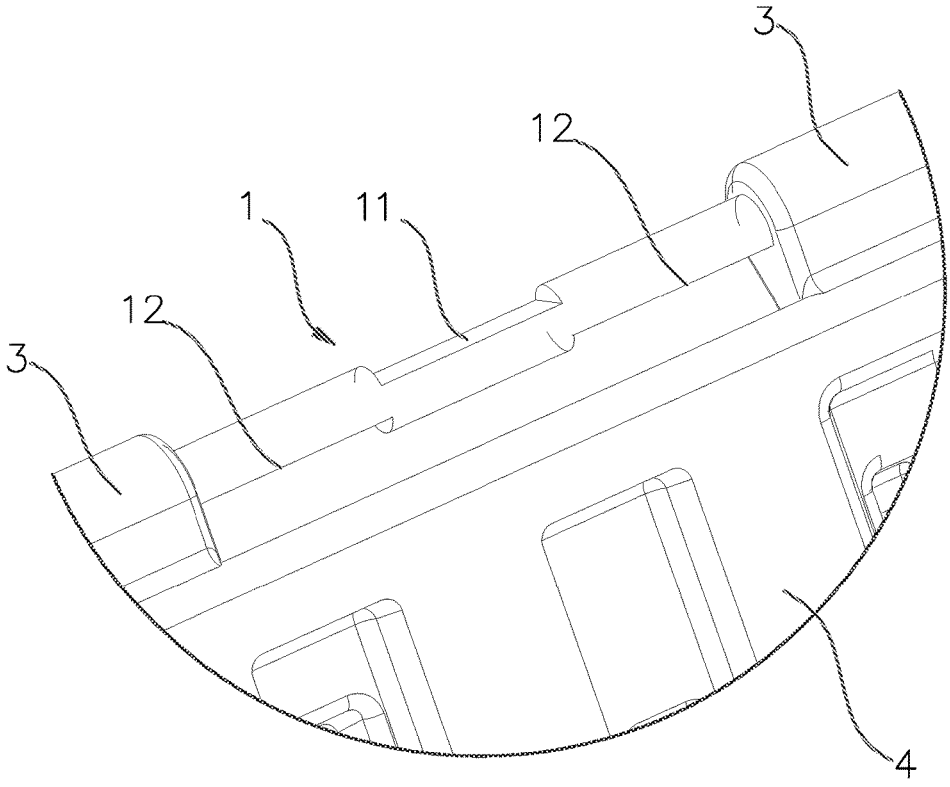
FIG. 6 is an enlarged schematic of the portion C in FIG. 5.
Figure 7:
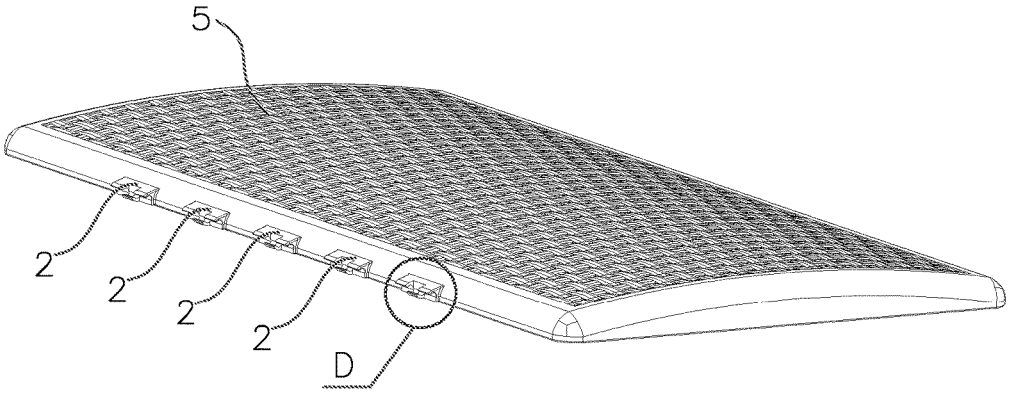
FIG. 7 is a structural schematic of the cover board according to an embodiment of the present disclosure.
Figure 8:
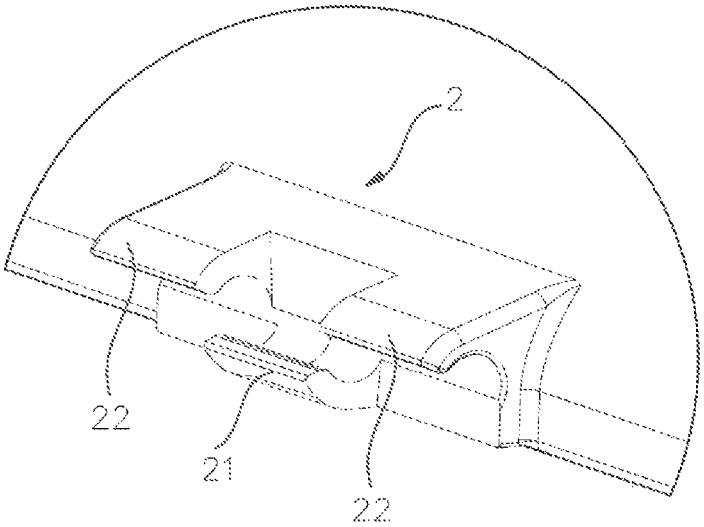
FIG. 8 is an enlarged schematic of the portion D in FIG. 7.

According to some embodiments, when the rear board 4 is in a vertical installing position, the first cutting face 11 and the second cutting face 12 are able to be both aligned at level surfaces. Therefore, as shown in FIG. 3 and FIG. 4, only when the cover board 5 is in a position perpendicular to the rear board 4, i.e., when the cover board 5 is in a level position, the hinge arm 2 can be installed to or detached from the hinge shaft 1. When the cover board 5 is in a non-level position, the hinge arm 2 cannot be installed on the hinge shaft 1. That is, in this case, the cover board 5 cannot be installed on the rear board 4. Similarly, as shown in FIG. 1 and FIG. 2, after the cover board 5 has been installed on the rear board 4, when the cover board 5 rotates in any angle and is in a non-level position, the cover board 5 will not detach from the rear board 4.

The embodiments described above are only some of the preferred embodiments of the present disclosure. It would be understood by a person skilled in the art that various changes and modifications can be made to the embodiments described herein without departing from the scope and spirit of the present disclosure. For example, the first cutting face and the second cutting face can be designed as inclined surfaces parallel to each other, so that disassembly and assembly can be done when the second connecting board forms a corresponding included angle with the first connecting board. Another example is that the hinge structure may also be applied in connecting other types of connecting members. Such changes and modifications should be considered as within the protection scope claimed by the present disclosure.

What is claimed is:

1. An integrated hinge structure, comprising:

a hinge shaft provided on a first connecting member; and a hinge arm provided on a second connecting member, the hinge arm configured to be rotatably connected to the hinge shaft, wherein the hinge shaft has staggered surface features allowing the hinge arm with corresponding staggered surface features only to be installed to or detached from the hinge shaft in a certain direction and allowing the installed hinge arm to rotate at any angle while staying securely connected to the hinge shaft.

2. The integrated hinge structure of claim 1, wherein the hinge shaft is a circular shaft and the staggered surface features are a first cutting face and a second cutting face that are parallel to each other are formed axially on a side of the hinge shaft, the first cutting face and the second cutting face both being alternately arranged, and respectively located on two opposite sides of the hinge shaft; and wherein, correspondingly, the hinge arm staggered surface features include a first arc-shaped embracing arm and a second arc-shaped embracing arm, the first arc-shaped embracing arm and the second arc-shaped embracing arm being alternately arranged with their arc opening facing each other, and respectively located on two opposite sides of the hinge arm; and, a vertical distance between opposite edges of the first arc-shaped embracing arm and the second arc-shaped embracing arm is greater than a vertical distance between the first cutting face and the second cutting face but smaller than a diameter of the hinge shaft.

3. The integrated hinge structure of claim 2, wherein the first cutting face (11) and the second cutting face (12) are precisely staggered along an axial direction of the hinge shaft (1), the first cutting face (11) and the second cutting face (12) having an equal cutting depth that is smaller than a radius of the hinge shaft (1); and, correspondingly, the first arc-shaped embracing arm (21) and the second arc-shaped embracing arm (22) are precisely staggered along an axial direction of the hinge arm (2).

4. The integrated hinge structure of claim 3, wherein the first cutting face (11) and the second cutting face (12) are the same in their axial width; and correspondingly the first arc-shaped embracing arm (21) and the second arc-shaped embracing arm (22) are the same in their axial width.

5. The integrated hinge structure of claim 2, wherein the hinge shaft (1) includes one first cutting face (11) and two second cutting faces (12), the first cutting face (11) being located between the two second cutting faces (12); and, correspondingly, the hinge arm (2) includes one first arc-shaped embracing arm (21) and two second arc-shaped embracing arms (22), the first arc-shaped embracing arm (21) being located between the two second arc-shaped embracing arms (22).

6. The integrated hinge structure of claim 2, wherein the first cutting face (11) and the second cutting face (12) are level surfaces.

7. The integrated hinge structure of claim 1, wherein the hinge shaft (1) is integrally formed on the first connecting member and the hinge arm (2) is integrally formed on the second connecting member.

8. The integrated hinge structure of claim 1, wherein the first connecting member is a first connecting board; the second connecting member is a second connecting board; a plurality of hinge mounts (3) and a plurality of the hinge shafts (1) are integrally formed along a length direction of a side edge of the first connecting board, the hinge shafts (1) being arranged on the hinge mounts (3) in an alternate manner with the hinge mounts (3); and, correspondingly, a plurality of the hinge arms (2) are integrally formed in an spaced manner along a length direction of a corresponding side edge of the second connecting board.

9. A hinge structure, comprising:

a hinge shaft (1) provided on a first connecting member, the hinge shaft (1) having one or more cutting surfaces configured to be parallel to each other; and a hinge arm (2) provided on a second connecting member, the hinge arm (2) having one or more arc-sharped embracing arms configured to respectively receive the hinge shaft (1) through the one or more cutting surfaces at a predetermined direction;

wherein the hinge shaft (1) is configured to:

rotate freely and securely in the hinge arm (2); and only attach and detach from the hinge arm (2) at the predetermined direction.

10. The hinge structure of claim 9, wherein the hinge shaft (1) is a circular shaft.

11. The hinge structure of claim 9, wherein the one or more cutting surface are arranged on opposite sides of the hinge shaft (1).

12. The hinge structure of claim 9, wherein the predetermined direction is one of a horizontal direction or an inclined direction.

13. The hinge structure of claim 9, wherein the one or more arc-sharped embracing arms are alternately arranged with one or more arc openings facing each other, and respectively located on opposite sides of the hinge arm (2).

14. The hinge structure of claim 9, wherein the hinge shaft (1) is integrally formed on the first connecting member without any fixation means.

15. The hinge structure of claim 9, wherein the hinge arm (2) is integrally formed on the second connecting member without any fixation means.

16. A box comprising:

a rear board;

a cover board configured to rotate and cover the box; and a hinge connecting the rear board to the cover board, the hinge having:

a hinge arm integrally formed with either the rear board or the cover board, the hinge arm having a plurality of arc-shaped embracing arms, and a hinge shaft integrally formed with either the rear board or the cover board, the hinge shaft having a cylindrical shape with one or more flat regions formed axially along the hinge shaft, each flat region axially aligning with a respective one of the arc-shaped embracing arms;

wherein the one or more flat regions enable the hinge shaft to attach and detach from the hinge arms from a predetermined direction.

17. The box of claim 16, wherein the one or more flat regions is three or more flat regions arranged in a staggered manner along an axis of the hinge shaft.

18. The box of claim 16, wherein the one or more flat regions includes a plurality of flat regions that are parallel to one another.

19. The box of claim 16, wherein the one or more flat regions enable the hinge shaft to attach and detach from the hinge arms at a predetermined angle.

* * * * *